US006635984B1

(12) United States Patent
Shibata

(10) Patent No.: US 6,635,984 B1
(45) Date of Patent: Oct. 21, 2003

(54) IMAGE-FORMING APPARATUS

(75) Inventor: Masaaki Shibata, Ninomiya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,832

(22) Filed: Feb. 25, 2000

(30) Foreign Application Priority Data

Mar. 5, 1999 (JP) ..... 11-058457
Feb. 18, 2000 (JP) ..... 2000-041906

(51) Int. Cl.[7] ..... H01J 19/24

(52) U.S. Cl. ..... 313/495; 313/496; 313/497

(58) Field of Search ..... 313/495, 496, 313/497, 422, 310, 309, 505; 345/74

(56) References Cited

U.S. PATENT DOCUMENTS

| | | | | |
|---|---|---|---|---|
| 4,999,539 A | * | 3/1991 | Coovert et al. | 313/505 |
| 5,023,110 A | | 6/1991 | Nomura et al. | 427/49 |
| 5,066,883 A | | 11/1991 | Yoshioka et al. | 313/309 |
| 5,659,329 A | * | 8/1997 | Yamanobe et al. | 313/309 |
| 5,695,378 A | * | 12/1997 | Hecker, Jr. et al. | 445/24 |

FOREIGN PATENT DOCUMENTS

| | | |
|---|---|---|
| EP | 0 660 357 | 6/1995 |
| EP | 0 717 428 | 6/1996 |
| JP | 2-56822 | 2/1990 |
| JP | 2-056822 | 2/1990 |
| JP | 6-342636 | 12/1994 |
| JP | 7-235255 | 9/1995 |
| JP | 8-180797 | 7/1996 |
| JP | 9-17333 | 1/1997 |
| JP | 9-017333 | 1/1997 |
| JP | 9-069334 | 3/1997 |
| JP | 9-69334 | 11/1997 |

OTHER PUBLICATIONS

M.I. Elinson et al., "The Emission of Hot Electrons and the Field Emission of Electrons From Tin Oxide," *Radio Engineering and Electronic Physics*, IEEE, 1290–1296 (1965).
G. Dittmer, "Electrical Condition and Electron Emission of Discontinuous Thin Films," *9 Thin Solid Films* 317–328 (1972).
M. Hartwell et al., "Strong Electron Emission From Patterned Tin–Indium Oxide Thin Films," 23(1) *IEDM Technical Digest* 519–521 (1975).
H.Araki et al., "Electroforming and Electron Emission of Carbon Thin Films," 26(1) *Journal of the Vacuum Society of Japan* 22–29 (1983).
M.I. Elinson et al., "The Emission of Hot Electrons and the Field Emission of Electrons from Tin Oxide," *Radio Eng. and Electronic Physics,* (Jul. 1965) pp. 1290–1296.
G. Dittmer, "Electrical Conduction and Electron Emission of Discontinuous Thin Films," *Thin Solid Films*, 9 (1972) pp. 317–328.
M. Hartwell and C.G. Fonstad, "Strong Electron Emission from Patterned Tin–Indium Oxide Thin Films," *Int'l Electron Devices Meeting*, Washington, D.C. (1975) pp. 519–521.
H. Araki et al., "Electroforming and Electron Emission of Carbon Thin Films," *J. Vacuum Soc. Japan*, vol. 26, No. 1 (1983) pp. 22–29.

* cited by examiner

*Primary Examiner*—Sandra O'Shea
*Assistant Examiner*—Bao Q. Truong
(74) *Attorney, Agent, or Firm*—Fitzpatrick, Cella, Harper & Scinto

(57) ABSTRACT

An image-forming apparatus capable of obtaining an image of high quality is provided, in which the image-forming apparatus has a region formed such that the widths of X- and Y-directional wirings on the outer side of an image forming region in proximity to the image forming region are wider than those within the image forming region.

15 Claims, 13 Drawing Sheets

IMAGE-FORMING APPARATUS

BACKGROUND OF THE INVENTION

1. Field of the Invention

The present invention relates to an image-forming apparatus, and more particularly, to a flat type image-forming apparatus using an electron-emitting device.

2. Related Background Art

A flat panel display is conventionally known as an image-forming apparatus utilizing an electron-emitting device, in which an electron source substrate having many cold cathodes therein and an anode substrate having an electrode and a fluorescent substance are oppositely arranged in parallel with each other, and a vacuum exhausting operation is performed.

For example, such an image-forming apparatus using a field emitter is disclosed in I. Brodie, "Advanced technology: flat cold-cathode CRTs"; Information Display, 1/89, 17(1989), U.S. Pat. No. 5,695,378, etc.

Further, for example, an image-forming apparatus using a surface conduction electron-emitting device is disclosed in U.S. Pat. No. 5,066,883, etc.

The flat panel display can be made light in weight and large-sized in screen in comparison with a cathode ray tube (CRT) display unit widely used at present. In addition, the flat panel display using an electron beam can provide an image of higher luminance and higher quality in comparison with other flat panels such as liquid crystal display, a plasma display, an electroluminescent display, etc.

In particular, the surface conduction electron-emitting device is simple in structure and can be easily manufactured. The surface conduction electron-emitting device also has an advantage in that an electron source substrate in which many devices are arranged in a large area, can be manufactured without a complicated manufacturing process using a photolithography technique as in the field emitter.

FIGS. 12 and 13 show one example of the electron source substrate using the surface conduction electron-emitting device disclosed in Japanese Patent Application Laid-open No. 6-342636 of this applicant.

FIG. 12 shows a plan view of one portion of the electron source. Here, reference numerals 6, 7, 81 and 8 respectively designate a lower wiring, an upper wiring, a surface conduction electron-emitting device and an insulating layer. FIG. 13 is a perspective view in which a peripheral portion of the surface conduction electron-emitting device 81 in FIG. 12 is taken out. In FIG. 13, reference numeral 91 designates a substrate and reference numerals 2, 3 designate device electrodes. Further, reference numerals 4 and 95 respectively designate a conductive thin film having an electron emitting region, and the electron emitting region. The device electrodes 2 and 3 are respectively connected to the lower wiring 6 and the upper wiring 7 electrically insulated from each other by the insulating layer 8. Here, a predetermined voltage is sequentially applied to the upper wiring 7 and the lower wiring 6 arranged in a matrix shape as a scanning signal and an information signal, respectively. Thus, a predetermined electron-emitting device located at an intersection point of the matrix can be selectively operated.

The electron source substrate arranged in such a matrix can be manufactured by using a relatively simple photolithography technique, but a printing technique is preferably used when a larger substrate is formed. In particular, with respect to the upper wiring applying the scanning signal thereto, an electric current amount flowing through this wiring is increased as the number of devices connected to one line is increased. Therefore, a voltage drop due to wiring resistance is caused. Accordingly, it is preferable to reduce the resistance as much as possible by forming this wiring by a thick film.

Japanese Patent Application Laid-open Patent No. 8-180797, etc. disclose a manufacturing method for forming wirings and the insulating layer by a screen printing method. Further, for example, with respect to other members, a manufacturing method for forming device electrodes by an offset printing method, etc. is disclosed in Japanese Patent Application Laid-open No. 9-17333, etc. A manufacturing method for forming the conductive thin film by an ink jet method is disclosed in Japanese Patent Application Laid-open No. 9-69334, etc. The electron source substrate of a large area can be easily manufactured by using such printing techniques.

The surface conduction electron-emitting device will be explained next. The surface conduction electron-emitting device utilizes a phenomenon in which an electron is emitted by allowing an electric current to flow through the conductive thin film of a small area formed on the substrate in parallel with the film surface.

This surface conduction electron-emitting device is formed by using an $SnO_2$ thin film [M. I. Elinson, Radio Eng. Electron Phys., 10, 1290 (1965)], an Au thin film [G. Ditmmer, Thin Solid Films, 9, 317 (1972)], an $In_2O_3/SnO_2$ thin film [M. Hartwell and C. G. Fonsted, IEEE Trans. ED Conf., 519 (1975)], a carbon thin film [Hisashi ARAKI and others: Shinku (Vacuum), p. 22, No. 1, Vol. 26 (1983)], etc. For example, the applicant of this application proposed a surface conduction electron-emitting device using a palladium oxide film, etc. in Japanese Patent Application Laid-open No. 2-56822.

Generally, in manufacturing the surface conduction electron-emitting device, an electron emitting region is normally formed in the conductive thin film by electric current flowing process called "forming" or "energization forming". In the "forming" process, a direct current voltage or a very slow rising voltage, e.g., about 1 V/minute is applied to both ends of the conductive thin film and a gap is formed by locally breaking, deforming or deteriorating the conductive thin film. After the "forming" process is performed, the voltage is applied to the conductive thin film and an electric current flows through the device so that electrons are emitted from a region near the gap. At this time, the region emitting the electrons is called the "electron emitting region".

Further, for example, as proposed by the present applicant in Japanese Patent Application Laid-open No. 7-235255, an activating process is performed with respect to the device terminated in the "forming" processing so that the electrons can be more preferably emitted. Similar to the "forming" process, the activating process can be performed by repeatedly applying a pulse voltage to the device in an atmosphere including a gas of an organic substance. Thus, carbon and/or a carbon compound is deposited onto the device from the organic substance existing in the atmosphere so that a device electric current If and an emission current Ie are greatly increased.

The surface conduction electron-emitting device manufactured through the above processes has an electron emitting characteristic sufficient as an electron source applicable to an image-forming apparatus such as a flat panel display.

SUMMARY OF THE INVENTION

According to a first aspect of the present invention, there is provided an image-forming apparatus, characterized in that:

the image-forming apparatus includes an airtight container (vacuum vessel) comprising:

an electron source substrate in which a plurality of electron-emitting devices connected to m pieces of X-directional wirings and n pieces of Y-directional wirings electrically insulated from each other are arranged in matrix; and a face plate arranged oppositely to the electron source substrate and having a fluorescent film and an anode electrode (conductive film), and that:

the interior of the airtight container (vacuum vessel) has a region in which widths of the X and Y directional wirings arranged on the outer side of an image forming region are wider than those arranged within said image forming region.

According to a second aspect of the present invention, there is provided an image-forming apparatus, characterized in that:

the image-forming apparatus has an airtight container comprising:

an electron source substrate in which plural electron-emitting devices connected to m pieces of X-directional wirings and n pieces of Y-directional wirings electrically insulated from each other are arranged in matrix; and a face plate arranged oppositely to the electron source substrate and having a fluorescent film and an anode electrode, and that:

an image forming region substantially formed in a rectangular shape is arranged within the airtight container; and an outer side of the image forming region in proximity to four corners of the image forming region has a region in which widths of the X or Y directional wirings are wide in comparison with the interior of the image forming region.

According to a third aspect of the present invention, there is provided an image-forming apparatus having an image forming region approximately formed in a rectangular shape, comprising:

an electron source substrate in which electron-emitting devices are connected to m pieces of X-directional wirings and n pieces of Y-directional wirings electrically insulated from each other, and are arranged in matrix; and a face plate spaced oppositely to the electron source substrate approximately at a constant distance and having an anode electrode arranging a fluorescent film therein, characterized in that conductive members electrically connected to at least one of the wirings are respectively arranged at four outside corners of the image forming region in proximity to the image forming region.

Preferably, the conductive members are electrically connected to at least one of the wirings except for a most proximate wiring.

In addition, in the image-forming apparatus of the present invention, cold cathodes can be preferably used as the electron-emitting devices. Furthermore, surface conduction electron-emitting devices can be preferably used as the electron-emitting devices.

In the image-forming apparatus according to the second aspect of the present invention, the widths of the wirings on the outer side of the image forming region in proximity to the image forming region are wider than those within the image forming region. Accordingly, an exposed area of a substrate surface can be reduced and charging in this region can be restrained to a minimum.

In the image-forming apparatus according to the third aspect of the present invention, the widths of the wirings are widely set at the four outside corners of the image forming region in proximity to the image forming region. Accordingly, an exposed area of a substrate surface can be reduced and charging in this region can be restrained to a minimum.

In the image-forming apparatus according to the first aspect of the present invention, conductive members electrically connected to at least one of the wirings are respectively arranged at the four outside corners of the image forming region in proximity to the image forming region. Accordingly, the exposed area on the substrate surface can be reduced and charging in this region can be restrained to a minimum. Further, the above conductive members are electrically connected to at least one of the above wirings except for a most proximate wiring so that electric potentials of the conductive members can be prescribed when a device closest to the conductive members is operated.

DESCRIPTION OF THE PREFERRED EMBODIMENTS

In an image-forming apparatus utilizing an electron-emitting device as well as the above surface conduction electron-emitting device, it is preferable to sufficiently accelerate an emitted electron and irradiate the emitted electron to a fluorescent substance so as to obtain an image of high luminance. It is necessary to use the image-forming apparatus by applying a high voltage (equal to or greater than 1 kV, preferably equal to or greater than 6 kV) between the above electron source substrate and an anode substrate. It is also necessary to space the above electron source substrate and the anode substrate from each other (at a distance equal to or greater than 1 mm) so as not to cause an electric discharge (dielectric breakdown) between the substrates in such a high voltage. It is further necessary to exhaust and set the interior of the image-forming apparatus to a sufficient vacuum state so as to set the range of an electron to be equal to or greater than the distance between the electron source substrate and the anode substrate. Therefore, when a surface of high electric resistance is exposed in the vicinity of the electron-emitting device, there is a case in which this surface is charged. When an area of this charged surface is particularly large, this area has an influence on an orbit of the emitted electron from the electron-emitting device. Therefore, there is a case in which an image of high quality is damaged.

An object of the present invention is to provide an image-forming apparatus for obtaining an image of high quality.

Preferred embodiment modes of the present invention will next be explained.

Figure 1:
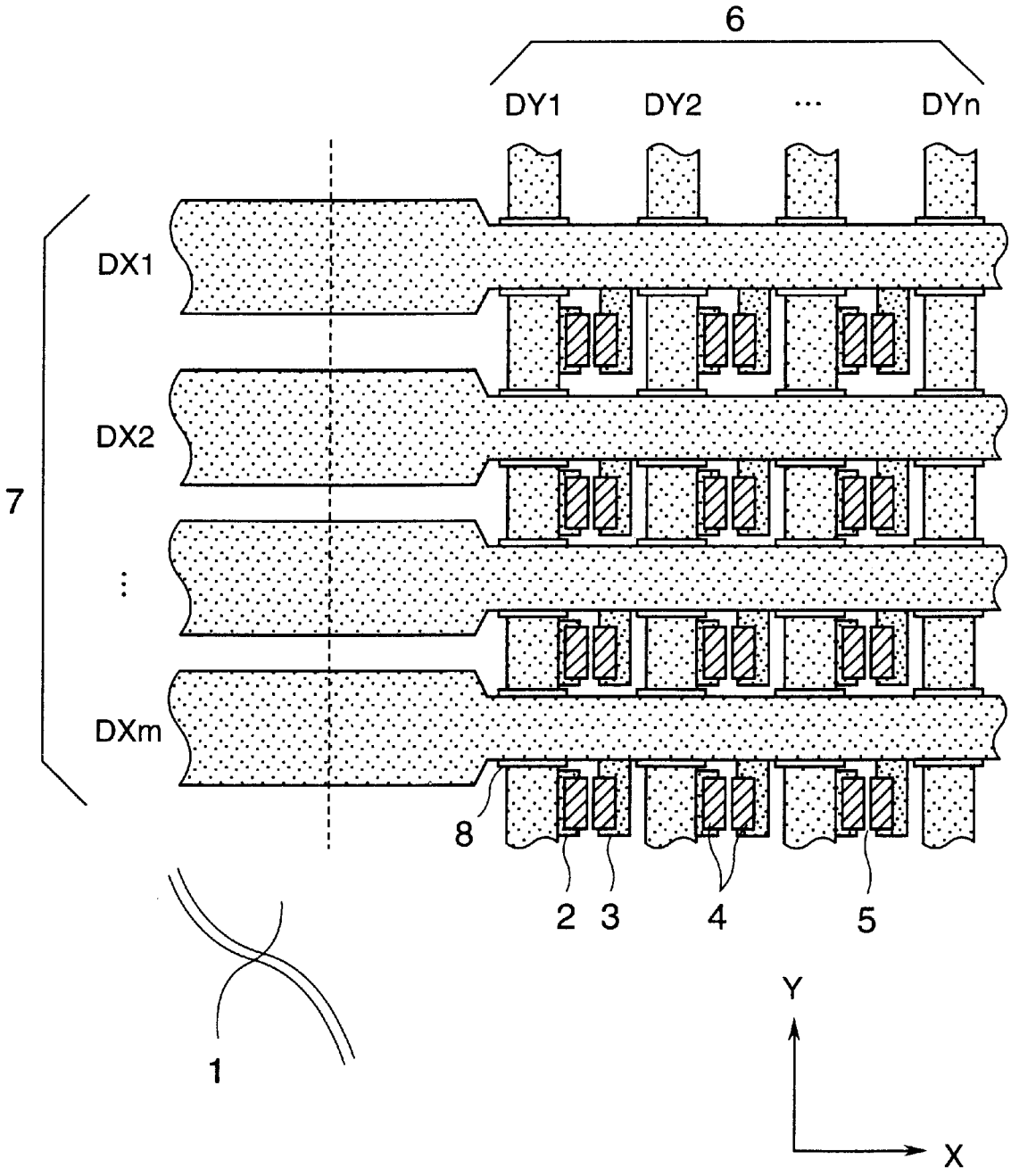
FIG. 1 is a plan view showing one example of a peripheral portion of an image forming region at its left-hand end in an image-forming apparatus of the present invention.
Figure 2:
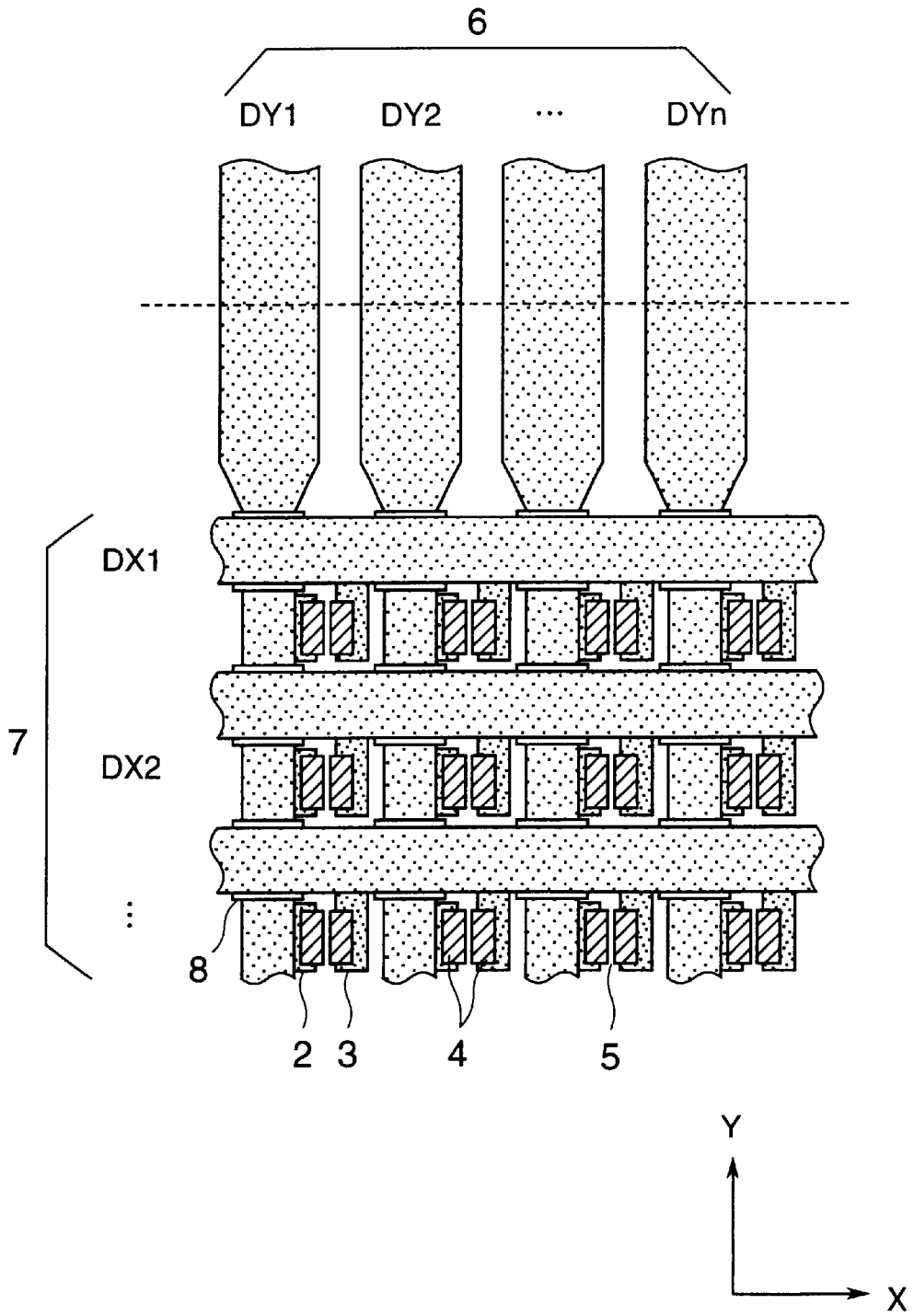
FIG. 2 is a plan view showing one example of a peripheral portion of the image forming region at its upper end in the image-forming apparatus of the present invention.

FIGS. 1 and 2 are plan views showing the schematic structure of an image-forming apparatus in the second present invention using an electron source substrate in which electron-emitting devices are arranged in matrix. FIG. 1 shows an enlarged peripheral area of an image forming region at its left-hand end and FIG. 2 shows an enlarged peripheral area of the image forming region at its upper end. Right-hand and lower ends of the image forming region also respectively have symmetrical shapes with respect to FIGS. 1 and 2. An arranging region of the above electron source (electron-emitting device) is substantially a rectangular region.

Here, the "image forming region" in the present invention basically means an arranging region of the electron-emitting devices, i.e., an inside region of a line connecting devices located at most ends and a region on a face plate opposed to this inside region. However, the "image forming region" actually also includes a region in which widening of electron beams emitted from the devices located at most ends is considered since the electron beams are widened. In other words, the "image forming region" means an inside region in which the beams emitted from the devices located at most ends are formed as spots on an anode (face plate), and a region on a rear plate opposed to this inside region.

Here, an example using a surface conduction electron-emitting device as the electron-emitting device is shown. However, it is also possible to use cold cathodes of other kinds, e.g., a metal/insulator/metal (MIM) type electron-emitting device, a field emitter, etc.

In FIGS. 1 and 2, reference numeral 1 denotes a substrate and reference numerals 2, 3 denote device electrodes. Reference numerals 4 and 5 respectively designate a conductive film and a gap. Wirings 6, 7 are respectively connected to the device electrodes 2, 3. Reference numeral 8 designates an insulating layer for electrically insulating the wirings 6 and 7 from each other.

In each of these figures, a broken line corresponds to the position of an anode electrode formed on an unillustrated face plate oppositely arranged. The wirings 6 and 7 are respectively called Y-directional and X-directional wirings with reference to coordinates in FIGS. 1 and 2. There is also a case in which these wirings 6 and 7 are respectively called lower and upper wirings in accordance with a position relation of these wirings 6, 7 and the insulating layer 8.

As described later, the substrate 1 is preferably constructed by using a glass substrate cheaply manufactured and having a preferable processing property since heat treatment is carried out in a manufacturing process and it is necessary to form a vacuum atmosphere.

For example, the opposed device electrodes 2, 3 are metallic thin films made from a noble metal such as Au, Pt, or Pd, and having about several ten nm in thickness.

For example, the conductive film 4 is preferably constructed by using a Pd film approximately having a thickness from several nm to several ten nm and constructed by Pd particles of about several nm in size so as to easily form a gap by the "energization forming".

A film containing carbon (carbon film) is oppositely arranged within the gap formed in the conductive film 4 so that the gap 5 is further narrowly formed. Electrons are emitted from a portion near this gap 5.

As shown in FIGS. 1 and 2, the wirings 6, 7 are arranged to supply an electric current to plural electron-emitting devices.

The m pieces of X-directional wirings 7 are constructed by DX1, DX2, . . . , DXm, and the n pieces of Y-directional wirings 6 are constructed by DY1, DY2, . . . , DYn (these numbers m and n are positive integers). Materials, film thicknesses, wiring widths, etc. are designed such that an approximately equal voltage is supplied to many electron-emitting devices. Insulating layers 8 are arranged between the m pieces of X-directional wirings 7 and the n pieces of Y-directional wirings 6, and these wirings are electrically separated from each other so that a matrix wiring is constructed.

The wirings 6, 7 are respectively pulled out until they reach an outer side of the image forming region. Widths of the wirings 6, 7 are widened in this area. This is because an exposure area of a substrate surface is reduced on the outer side of the image forming region so that no charging is easily caused in this area.

An unillustrated scanning signal applying means for applying a scanning signal for selecting a row of electron-emitting devices arranged in an X-direction is connected to the X-directional wirings 7 in the structure shown in FIGS. 1 and 2, i.e., in the structure of the matrix arrangement. An unillustrated modulating signal generating means for modulating each column of electron-emitting devices arranged in a Y-direction in accordance with an input signal is connected to the Y-directional wirings 6.

A driving voltage applied to each electron-emitting device is supplied as a differential voltage of a modulating signal and the scanning signal applied to this device. The individual device can be selected and independently operated by using a simple matrix wiring.

Figure 3:
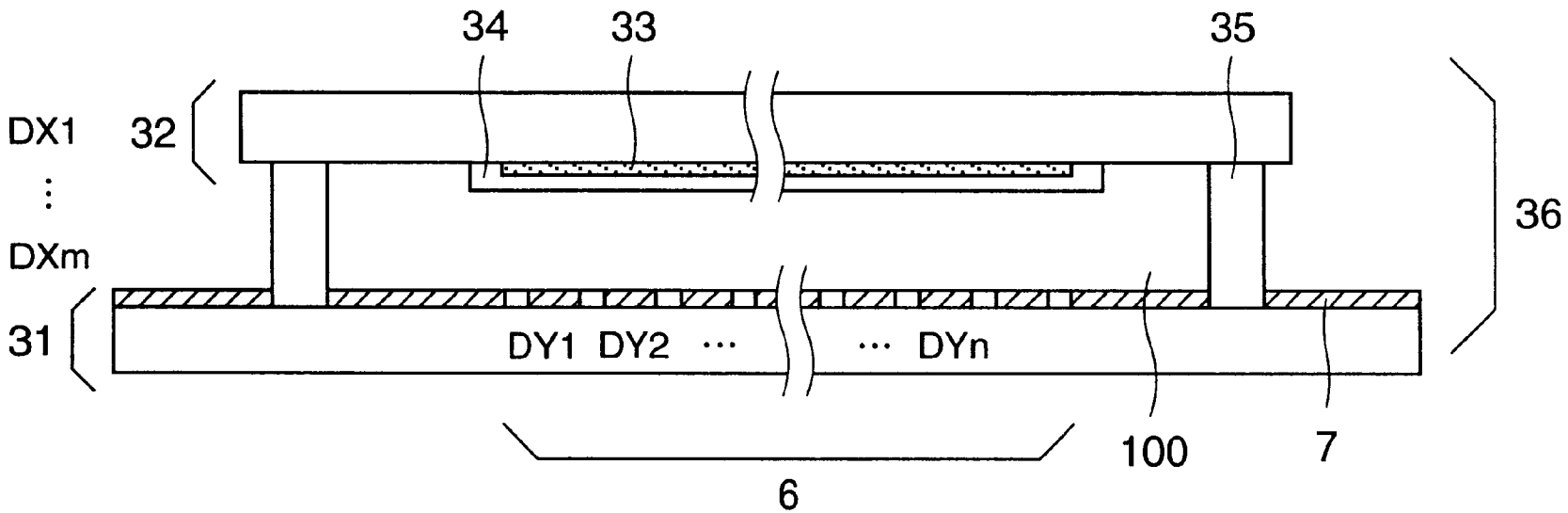
FIG. 3 is a cross-sectional view showing the image-forming apparatus of the present invention.

FIG. 3 is a view seen from a sectional direction of the first image-forming apparatus of the present invention shown in FIGS. 1 and 2.

In FIG. 3, reference numerals 31 and 32 respectively denote a rear plate as a substrate having the electron source therein, and a face plate in which a fluorescent film 33, a metal back (anode electrode) 34, etc. are formed on the inner face of a transparent substrate.

Here, the substrate used in the rear plate 31 and the face plate 32 are preferably constructed by using the same coefficient of thermal expansion, i.e., the same material and are preferably constructed by using a glass substrate.

The fluorescent film 33 has a fluorescent substance emitting light when an electron emitted from the electron-emitting device is irradiated to this fluorescent substance. Here, the fluorescent film 33 can be constructed by using a fluorescent film for color display in which fluorescent substances emitting red, blue and green lights are sequentially arranged and black stripes are arranged on boundaries of these fluorescent substances. The fluorescent film 33 can be also constructed by using a fluorescent film for monochrome in which fluorescent substances of one kind are arranged.

The metal back (anode electrode, conductive film) 34 is arranged to improve luminance by reflecting light on an inner face side among the light emitted from the fluorescent substance onto a side of the face plate 32 on a mirror face, and protect the fluorescent substance from damage due to the collision of ions generated within a vacuum container, etc. The metal back 34 is formed by using an aluminum thin film. Since the metal back 34 is a conductor, the metal back 34 can function as an electrode for applying a voltage for accelerating an electron emitted from the electron-emitting device and irradiating this electron to the fluorescent substance, i.e., as an anode electrode.

Reference numeral 35 designates a supporting frame. The rear plate 31, the supporting frame 35 and the face plate 32 are coated with frit glass, etc., and are heated and baked so that the rear plate 31, the supporting frame 35 and the face plate 32 are sealed and joined to each other and constitute an airtight container 36. Here, the frit glass is preferably used in conformity with the coefficient of thermal expansion of the substrate since separation, deformation, a crack of the substrate, etc. are not easily caused.

An airtight container (vessel) 36 having a sufficient strength with respect to the atmospheric pressure can also be constructed by arranging an unillustrated supporting body called a "spacer" between the face plate 32 and the rear plate 31.

The range of an electron emitted from the electron-emitting device is secured in the interior 100 of the airtight container 36 and the air (gas) within the airtight container 36 is exhausted in a vacuum to stabilize device characteristics. Here, preferable vacuum degrees differ from each other in accordance with a form of the used electron-emitting device, etc. However, for example, a vacuum degree equal to or smaller than about $1\times10^{-7}$ Torr is preferably held in the above surface conduction electron-emitting device.

There is a case in which a getter is arranged within the airtight container 36 to maintain the vacuum degree of the airtight container 36. The getter is arranged in an unillustrated predetermined position within the airtight container 36 by a heating method such as resistance heating, high frequency heating, or the like, just before or after the airtight container 36 is sealed. This getter is heated so that an evaporation film is formed. A main component of the getter is normally constructed by Ba, etc., and the above vacuum degree is maintained by an adsorbing action of the evaporation film.

The above "image forming region" in the present invention is naturally stored in the interior 100 of the above airtight container. A region directly uncontributing to image formation also exists within the above airtight container.

In the image-forming apparatus in the present invention, the fluorescent substance used in the fluorescent film 33 is preferably constructed by using a high voltage type fluorescent substance of high light conversion efficiency used in a general cathode ray tube (CRT) to form an image preferable in luminance and color purity. Therefore, a voltage from several kV to ten several kV is required as an anode voltage applied to the above anode electrode, i.e., the metal back 34 so as to use the high voltage type fluorescent substance in a preferable state. Accordingly, the distance between the rear plate 31 and the face plate 32 is preferably set to be equal to or greater than about 1 mm so as not to cause dielectric breakdown in a vacuum. Therefore, the supporting frame 35 is preferably set to be equal to or greater than about 1 mm in height.

In the image-forming apparatus having the above structure, the voltage is applied to a predetermined desirable electron-emitting device from an outer side of the airtight container through the wirings 6, 7 in an applying state of the anode voltage. Thus, an electron is emitted from this electron-emitting device and collides with the fluorescent film 33 and is excited and light is emitted from the fluorescent film 33 so that an image is displayed. However, when a face of high electric resistance is widely exposed to a surface of the rear plate 34 opposed to the anode electrode (here the metal back 34) within the airtight container, there is a case in which this exposed portion is charged and changes an orbit of the electron emitted from the electron-emitting device. Accordingly, in such a case, no emitted electron is irradiated to a predetermined desirable position on the fluorescent film 33 so that an image is disturbed.

Since the electron-emitting device and the wirings are formed within the image forming region, the above problem can be avoided by closely arranging the device and the wirings so as to reduce an exposure area on the face of high electric resistance as much as possible. However, the face of high electric resistance is exposed in a peripheral area of the image forming region, particularly, on an outer side of the image forming region with respect to a device located at a most end. Therefore, the image is easily disturbed in an end portion of the image forming region.

As mentioned above, in the image-forming apparatus according to the first aspect of the present invention, each of the wirings 6, 7 is pulled out until the outer side of the image forming region, i.e., an unforming place of the electron-emitting device, and is widened in width in this area so that the exposure area on the face of high electric resistance on the outer side of the image forming region is reduced. Therefore, the image disturbance can be prevented in the end portion of the image forming region.

The structure of an image-forming apparatus according to the second aspect of the present invention will next be explained by using FIG. 4.

Figure 4:
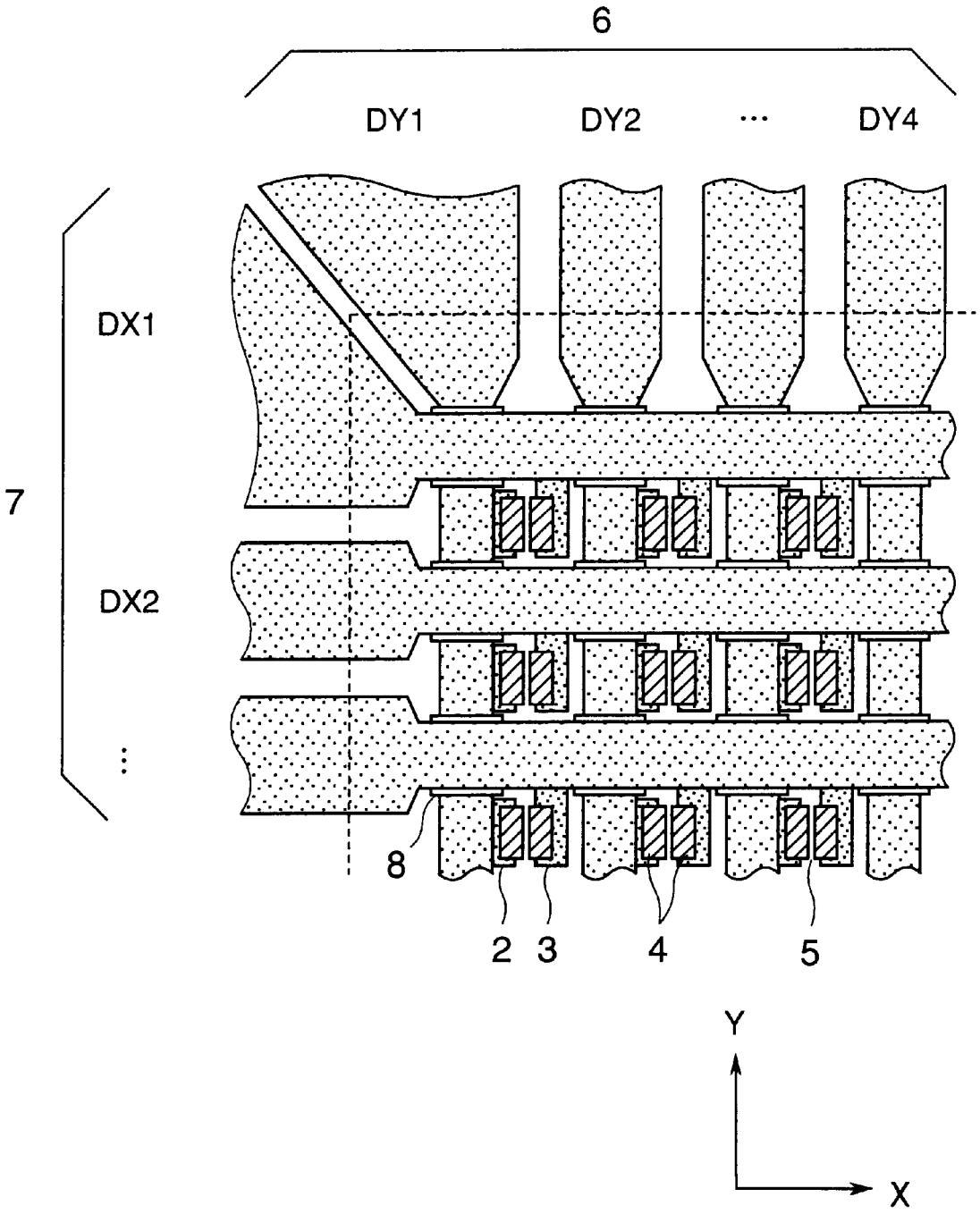
FIG. 4 is a plan view showing one example of a peripheral portion of the image forming region at its left-hand upper end in the image-forming apparatus of the present invention.
Figure 5:
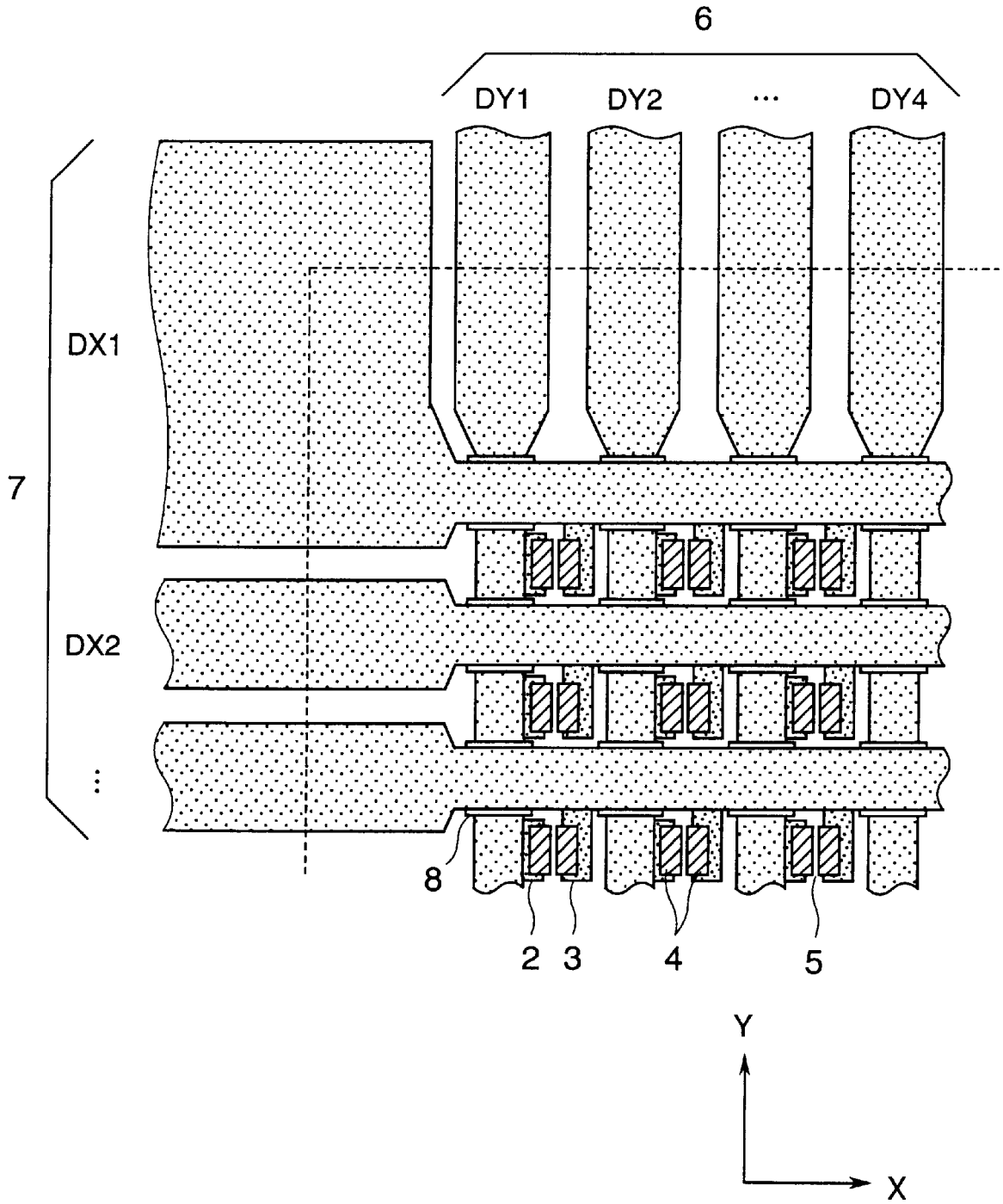
FIG. 5 is a plan view showing another example of the peripheral portion of the image forming region at its left-hand upper end in the image-forming apparatus of the present invention.
Figure 6:
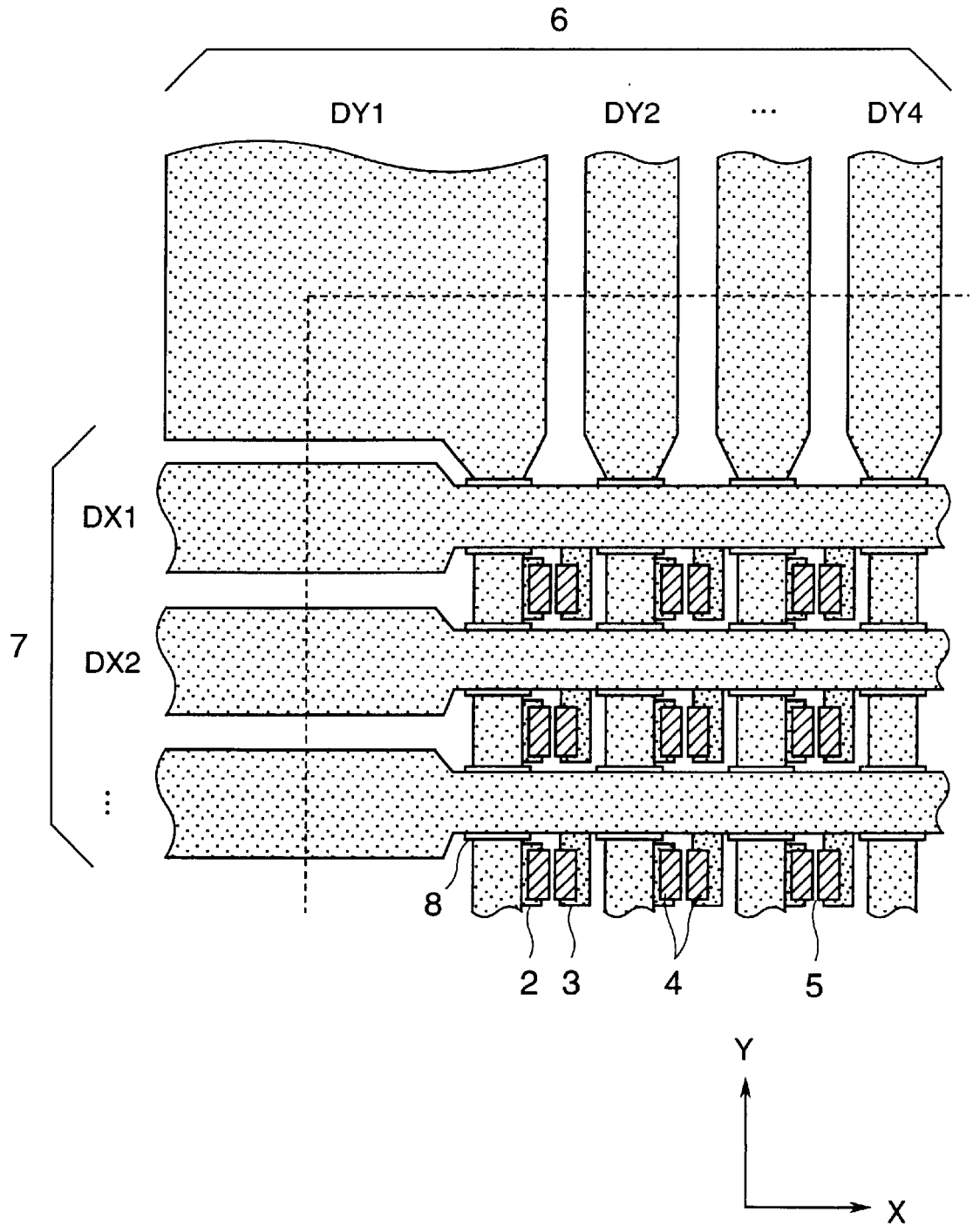
FIG. 6 is a plan view showing a still another example of the peripheral portion of the image forming region at its left-hand upper end in the image-forming apparatus of the present invention.

FIGS. 4, 5 and 6 are respectively plan views showing a schematic structure of the image-forming apparatus according to the second aspect of the present invention using an electron source substrate in which electron-emitting devices are arranged in matrix. FIGS. 4, 5 and 6 show an enlarged left-hand upper end region of an image forming region among its four corners. The other three corners also have a form similar to that of the left-hand upper end region. Members of reference numerals in FIGS. 4 to 6 are respectively equal to those of the same reference numerals as FIGS. 1 and 2.

First, as described before, m pieces of X-directional wirings 7 are constructed by DX1, DX2, . . . , DXm, and n pieces of Y-directional wirings 6 are constructed by DY1, DY2, . . . , DYn. Shapes of DX1 and DY1 are widely deformed at a left-hand upper end corner of the image forming region as shown in FIG. 4. This is because an exposure area on a substrate surface is reduced in a corner area on an outer side of the image forming region so that no charging in this area is easily caused. Similarly, DXm and DY1 at an unillustrated left-hand lower end, DX1 and DYn at an unillustrated right-hand upper end, and DXm and DYn at an unillustrated right-hand lower end are respectively widely deformed so that the exposure area on the substrate surface is reduced in corner areas on the outer side of the image forming region.

Here, an object of the present invention is to reduce the exposure area on the substrate surface in the corner areas on the outer side of the rectangular image forming region. Therefore, only the X-directional wiring (DX1 at the left-hand upper end) may be widely deformed as shown in FIG. 5, and only the Y-directional wiring (DY1 at the left-hand upper end) may be widely deformed as shown in FIG. 6.

A structure similar to that of the image-forming apparatus explained by using FIG. 3 is also used in an image-forming apparatus in the third present invention except for a wiring shape.

A face of high electric resistance on the outer side of the image forming region is most widely exposed with respect to devices located at the four corners of the rectangular image forming region so that the disturbance of an image is easily caused. Accordingly, as mentioned above, the exposure area on the face of high electric resistance on the outer side of the image forming region is reduced by widely deforming the wirings 6, 7 at the four corners of the outer side of the image forming region in the image-forming apparatus according to the second aspect of the present invention. Therefore, the image disturbance in a corner area of the image forming region can be restrained.

Figure 7:
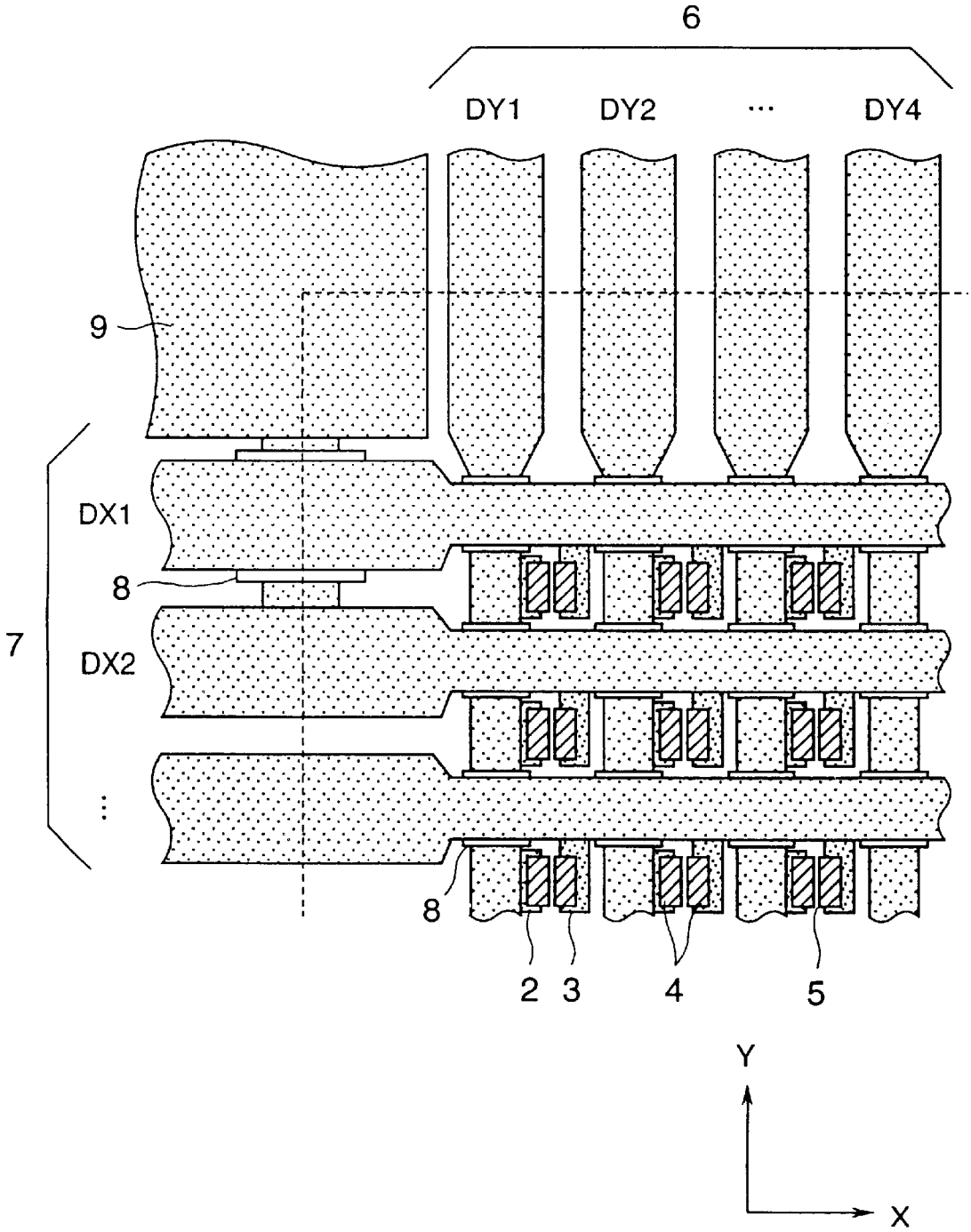
FIG. 7 is a plan view showing a still another example of the peripheral portion of the image forming region at its left-hand upper end in the image-forming apparatus of the present invention.

The structure of the image-forming apparatus according to the third aspect of the present invention will be further explained by using FIG. 7.

FIG. 7 is a plan view showing a schematic structure of the image-forming apparatus according to the third aspect of the present invention using an electron source substrate in which electron-emitting devices are arranged in matrix. FIG. 7 shows an enlarged left-hand upper end portion among the four corners of an image forming region. The other three corners also have a similar form. Members of reference numerals in FIG. 7 are respectively equal to those of the same reference numerals as in FIGS. 1, 2 and 4.

In FIG. 7, a conductive member 9 is arranged in a corner area of the image forming region on its outer side. The conductive member 9 is arranged to reduce an exposure area on a substrate surface in the corner area of the image forming region and can be constructed by using the same material as the wirings 6, 7. Here, an electric potential of the conductive member 9 can be prescribed by electrically connecting the conductive member 9 to one of the wirings 6, 7 such that the electric potential of the conductive member 9 is approximately equal to that of one of the wirings 6, 7.

In the structure shown in FIG. 7, i.e., in the structure of a matrix arrangement, an unillustrated scanning signal applying means for applying a scanning signal for selecting a row of electron-emitting devices arranged in an X-direction is connected to the X-directional wiring 7. An unillustrated modulating signal generating means for modulating each column of electron-emitting devices arranged in a Y-direction in accordance with an input signal is connected to the Y-directional wiring 6.

A driving voltage applied to each electron-emitting device is supplied as a differential voltage of a modulating signal and the scanning signal applied to this device. The individual device can be selected by using a simple matrix wiring and can be independently operated.

Here, in an example of normal simple matrix driving in which the electric potential is zero at a nonselecting time, the scanning signal (e.g., −Vop/2) applied to the X-directional wiring is sequentially applied from DX1 to DXm at a constant interval. The input signal (e.g., +Vop/2) is applied to the Y-directional wiring in conformity with timing in which the scanning signal is applied to the device to be selected. Here, Vop is a driving voltage applied to the device at a selecting time.

In the image-forming apparatus according to the first aspect of the present invention, a device most influenced by charging the substrate surface in a corner area of the image forming region is a device located at a corner, i.e., a device located at an intersection point of DX1 and DY1 at a left-hand upper end as shown in FIG. 7.

When this device is selected and emits an electron, the voltage is applied to both DX1 and DY1. Therefore, when the conductive member 9 is electrically connected to DX1 or DY1, an orbit of the electron emitted from the device located at the intersection point of DX1 and DY1 is influenced by the electric potential of the conductive member 9. No electric potentials of the Y-directional wirings except for DY1 can be prescribed since a voltage applying state in a certain arbitrary moment is different by an image displayed at that time.

Accordingly, a preferable wiring electrically connected is an X-directional wiring except for DX1 (most proximate wiring) to prescribe the electric potential of the conductive member 9 in a corner area at the left-hand upper end. Similarly, connection to an X-directional wiring except for DX1 is preferable in a right-hand upper end portion, and connection to an X-directional wiring except for DXm (most proximate wiring) is preferable in a left-hand lower end portion and a right-hand lower end portion. In reality, it is sufficient to set connection to wiring DX2 in the left-hand upper end portion and the right-hand upper end portion and connection to wiring DXm-1 in the left-hand lower end portion and the right-hand lower end portion.

There is a case in which no wiring for connecting the conductive member 9 is particularly considered in accordance with a driving method as mentioned above. In this case, a suitable electric potential may be prescribed in consideration of the driving method.

In the image-forming apparatus according to the first aspect of the present invention, a structure similar to that of the image-forming apparatus explained by using FIG. 3 is also used except for a wiring shape.

A face of high electric resistance on an outer side of the image forming region is most widely exposed with respect to devices located at four corners of the image forming region so that the disturbance of an image is easily caused. Accordingly, in the image-forming apparatus according to the third aspect of the present invention, as mentioned above, an exposure area on the face of high electric resistance on the outer side of the image forming region is reduced by forming the conductive member 9 at each of the four corners on the outer side of the image forming region. Therefore, the image disturbance can be prevented in a corner area of the image forming region.

The present invention will next be explained further in detail by giving concrete embodiments. However, the present invention is not limited to these embodiments, but also includes replacement of each device and a change in design within a scope in which the objects of the present invention are achieved.

Embodiment 1

The basic structure of an image-forming apparatus in this embodiment is similar to that shown in FIGS. 1, 2 and 3.

A manufacturing method of the image-forming apparatus in this embodiment is shown in FIGS. 8A through 9E. The basic structure and the manufacturing method of the image-forming apparatus in this embodiment will next be explained by using FIGS. 1 to 3, 8A through 9E.

For brevity, FIGS. 8A through 9E show one enlarged portion of the image-forming apparatus. This embodiment shows an example of the image-forming apparatus in which many electron-emitting devices are arranged in a simple matrix.

(Process-a)

Figure 8A:
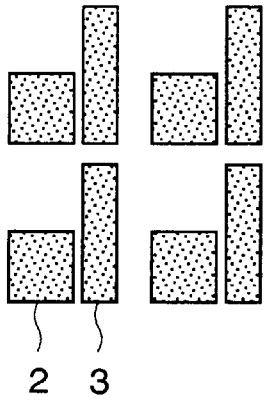
FIGS. 8A, 8B and 8C are plan views for explaining a manufacturing method of an electron source substrate in embodiment 1.

Ti of 5 nm in thickness and Pt of 50 nm in thickness are sequentially deposited on a cleaned glass substrate 1 by a sputtering method. Therefore, patterns of device electrodes 2, 3 are formed by photoresist and a Pt/Ti depositing layer except for the patterns of the device electrodes 2, 3 is removed by drying etching processing. The photoresist pattern is finally removed and the device electrodes 2, 3 are formed (FIG. 8A).

(Process-b)

Figure 8B:
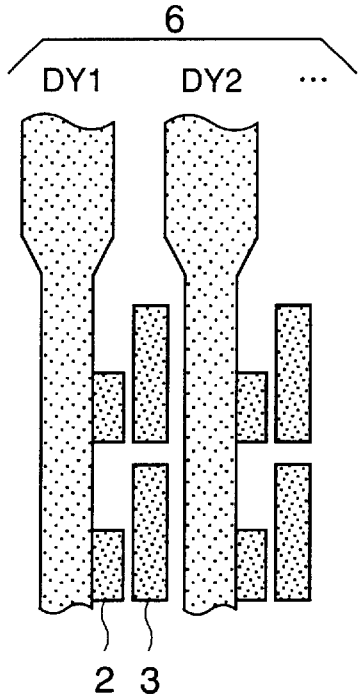

A pattern of wiring 6 is formed on the substrate 1 having the device electrodes 2, 3 therein by screen printing using Ag paste. After this pattern is dried, this pattern is baked at 500° C and the wiring 6 of a predetermined desirable shape made of Ag is formed (FIG. 8B).

Here, the wiring 6 is set to about 70 $\mu$m in width within an image forming region and the distance between wirings 6 is set to about 220 $\mu$m. The width of the wiring 6 is widened to 150 $\mu$m on an outer side of the image forming region, i.e., in a region on the outer side of a device electrode located at a most end, and the distance between the wirings 6, i.e., an exposure width on a substrate surface is set to about 140 $\mu$m. The wiring 6 is formed until an end of the substrate 1 such that this wiring 6 becomes a pull-out electrode as it is.

(Process-c)

Figure 8C:
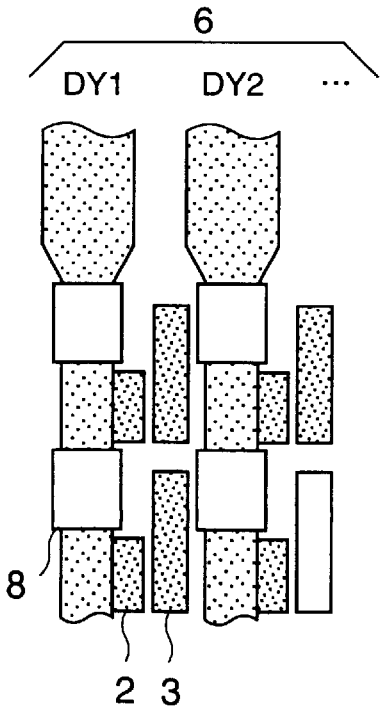
Figure 8C:
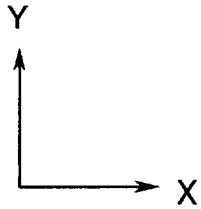

The pattern of an insulating layer 8 is next formed by the screen printing using glass paste. After this pattern is dried, this pattern is baked at 500° C. The glass paste is again repeatedly printed, dried and baked to obtain a sufficient insulating property so that the insulating layer 8 of a predetermined desirable shape made of glass is formed (FIG. 8C).

(Process-d)

Figure 9D:
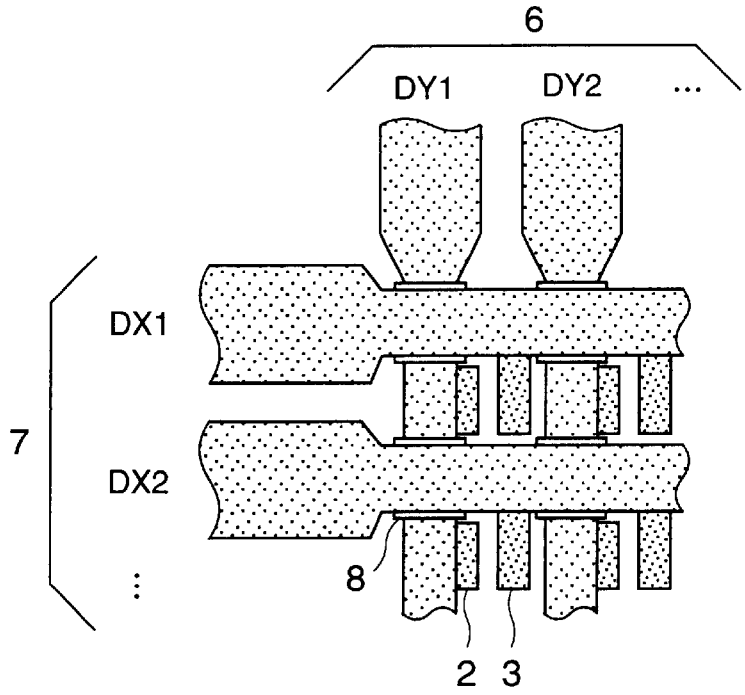
FIGS. 9D and 9E are plan views for explaining the manufacturing method of the electron source substrate in the embodiment.

The pattern of an upper wiring 7 is formed by the screen printing using Ag paste such that the upper wiring 7 crosses a lower wiring 6 in a forming portion of the insulating layer 8. After this pattern is dried, this pattern is baked at 500° C so that the upper wiring 7 of a predetermined desirable shape made of Ag is formed (FIG. 9D).

Here, the wiring 7 is set to about 280 $\mu$m in width within the image forming region and the distance between wirings 7 is set to about 340 $\mu$m. The width of the wiring 7 is widened to 440 $\mu$m on an outer side of the image forming region, i.e., in a region on the outer side of a device electrode located at a most end. The distance between the wirings 7, i.e., an exposure width on the substrate surface is set to about 180 $\mu$m. The wiring 7 is formed until an end of the substrate 1 such that this wiring 7 becomes a pull-out electrode as it is.

A substrate having the device electrodes 2, 3 connected to each other by the wirings 6, 7 in a matrix shape can be formed by the above processes.

(Process-e)

Figure 9E:
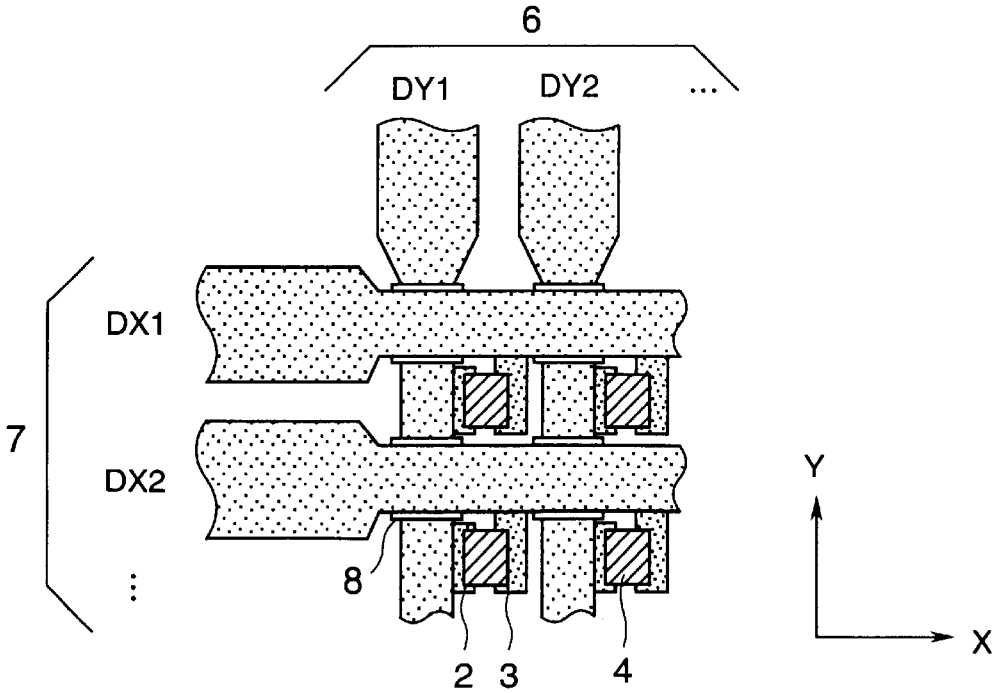

A conductive film 4 is next formed such that this conductive film 4 connects the device electrodes 2 and 3 (FIG. 9E).

The conductive film 4 is coated with an organic palladium solution in a predetermined desirable position by an ink jet method and is heated and baked for 30 minutes at 350° C. Thus, the obtained conductive film 4 is constructed by PdO as a main component and has about 10 nm in thickness.

The lower wiring 6, the insulating layer 8, the upper wiring 7, the device electrodes 2, 3 and the conductive film 4 are formed on the substrate 1 by the above processes and a rear plate is manufactured.

As shown in FIG. 3, a face plate 32 (constructed such that a fluorescent film 33 and a metal back 34 are formed on an inner face of the glass substrate) is next arranged by 2 mm above the rear plate 31 manufactured as mentioned above through supporting frames 35. A joining portion of the face plate 32, the supporting frames 35 and the rear plate 31 is coated with frit glass and is sealed and joined by baking this joining portion for 30 minutes at 400° C in the air. At this time point, these members are not completed as an airtight container.

The atmosphere within the glass container completed as mentioned above is exhausted by a vacuum pump through an unillustrated exhaust pipe. After a sufficient vacuum degree is attained, a voltage is applied between the device electrodes 2 and 3 through the wirings 6, 7 and "forming process" of the conductive film 4 is performed.

Thereafter, the exhausting operation is performed until the pressure within a panel reaches a level of $10^{-8}$ Torr. Thereafter, an organic substance is introduced into the panel from the exhaust pipe of the panel and is maintained such that a total pressure is equal to $1\times10^{-6}$ Torr. Further, a pulse voltage of 15 V in crest value is applied between the device electrodes 2 and 3 through the wirings 6, 7, and activating processing is performed.

Thus, a gap 5 is formed in the conductive film 4 by performing the "forming" and activating processing. Next, the exhausting operation is performed until about $10^{-7}$ Torr in pressure, and the unillustrated exhaust pipe is melted and attached by heating this pipe by a gas burner so that the container is sealed. Thus, the airtight container 36 is completed. Getter processing is finally performed by a high frequency heating method to maintain the pressure after the sealing.

In the image-forming apparatus of the present invention in which an unillustrated driving circuit is attached to the airtight container completed as mentioned above, a scanning signal and a modulating signal are respectively applied from an unillustrated signal generating means to each electron-emitting device through the wirings 7, 6 so that electrons are emitted from the electron-emitting device. A high voltage equal to or higher than 5 kV is applied to the metal back 34 and an electron beam is accelerated and collides with the fluorescent film 33. Thus, the fluorescent film 33 is excited and emits light so that an image is displayed.

The image-forming apparatus in this embodiment can stably display a preferable image for a long time with luminance (about 150 fL) able to be sufficiently satisfied as a television. An image of high quality having no image disturbance is also obtained in its peripheral portion.

Embodiments 2–4

The basic structure of an image-forming apparatus in this embodiment 2 is similar to that in FIGS. 3 and 4 to 6. Processes similar to those in FIGS. 8 and 9 are used in the manufacturing method of an electron source substrate in this embodiment.

The basic structure and the manufacturing method of the image-forming apparatus in this embodiment will next be explained by using FIGS. 4 to 6.

(Process-a)

Similar to the embodiment 1, device electrodes 2, 3 are formed on a cleaned glass substrate 1.

(Process-b)

Similar to the embodiment 1, wirings 6 are formed. Here, similar to FIG. 4, DY1 and DYn among the wirings 6 are widened in shape at four corners on the outer side of an image forming region.

(Process-c)

Similar to the embodiment 1, an insulating layer 8 is next formed.

(Process-d)

Similar to the embodiment 1, upper wirings 7 are formed.

Here, similar to FIG. 4, DX1 and DXm among the wirings 7 are widened in shape at four corners on the outer side of the image forming region. Here, the distance between DY1 and DX1 in the forming region widened in shape is set to be equal to or smaller than about 200 $\mu$m.

A substrate having the device electrodes 2, 3 connected to each other by the wirings 6, 7 in a matrix shape can be formed by the above processes.

After the process-e, the image-forming apparatus in this embodiment is manufactured by the same process as the embodiment 1 and an image is displayed.

As a result, a preferable image can be stably displayed for a long time with luminance (about 150 fL) able to be sufficiently satisfied as a television, and an image of high quality having no image disturbance is also obtained in each of four corner areas.

Further, a stable image of high quality having no image disturbance is similarly obtained for a long time in each of four corner areas in an embodiment 3 in which wirings 7 are formed as shown in FIG. 5 and an embodiment 4 in which wirings 6 are formed as shown in FIG. 6.

Embodiment 5

Figure 10A:
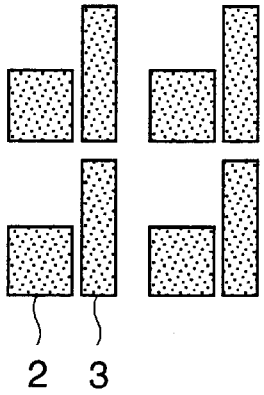
FIGS. 10A, 10B and 10C are plan views for explaining the manufacturing method of the electron source substrate in another embodiment.
Figure 10B:
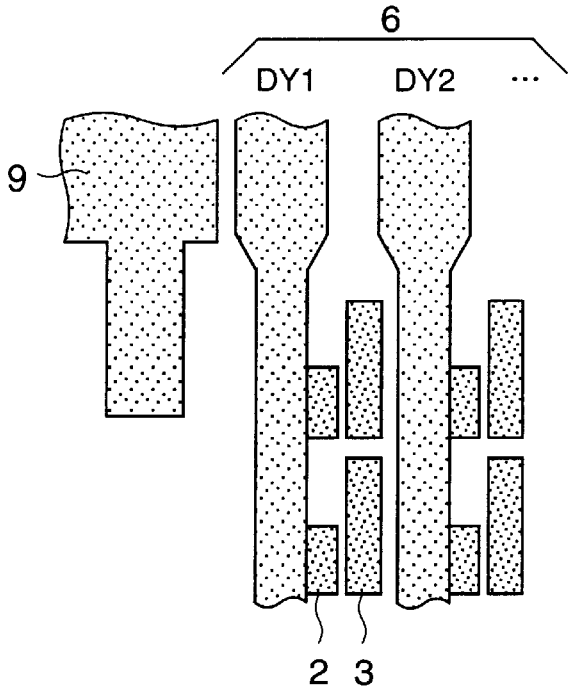
Figure 10C:
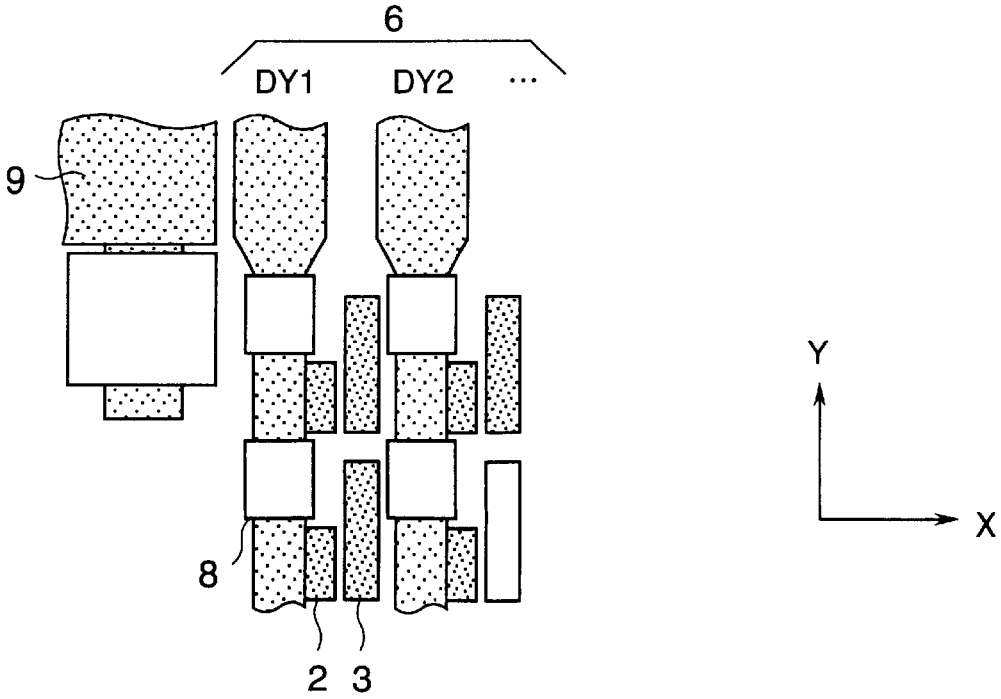
Figure 11D:
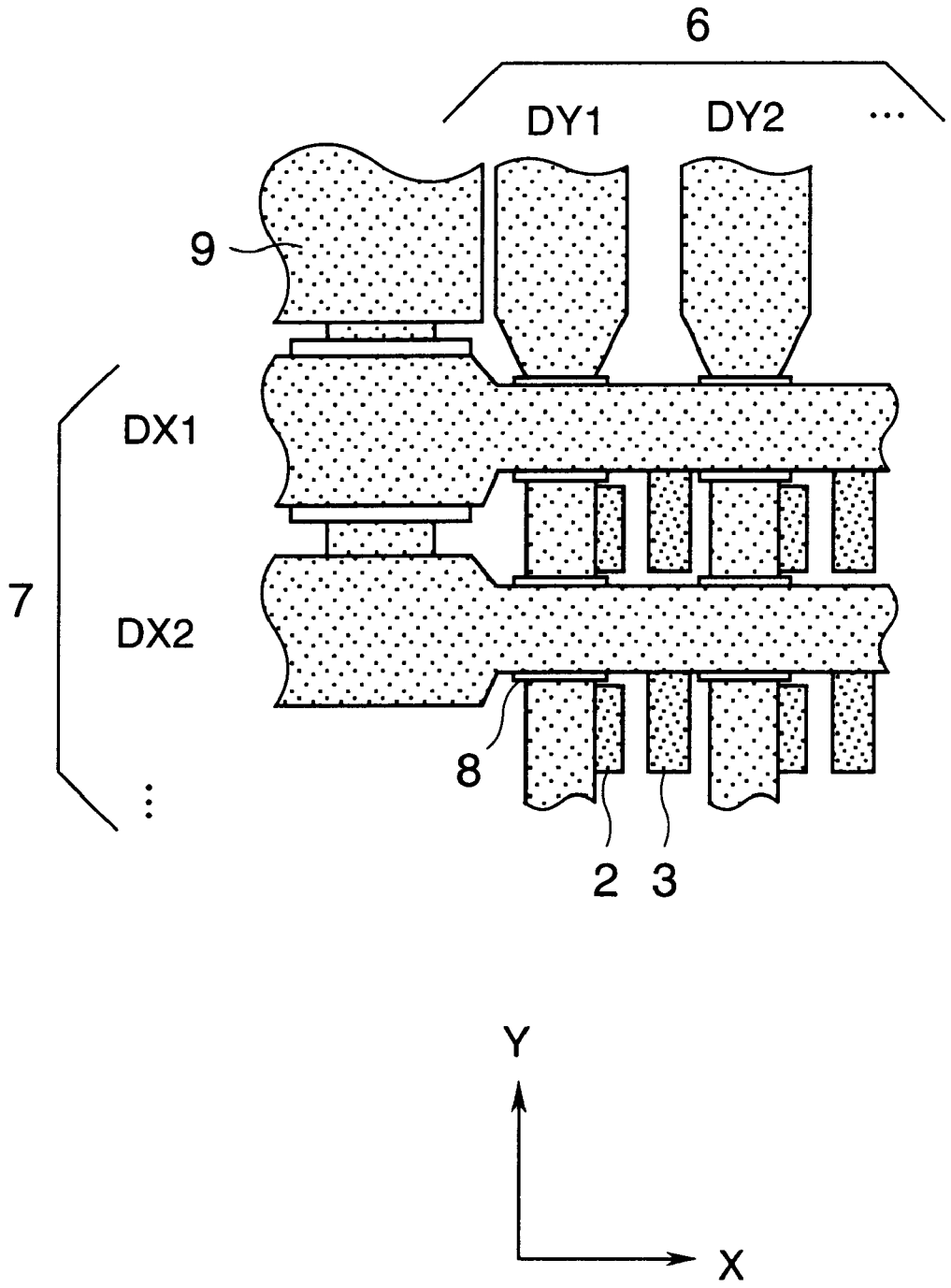
FIG. 11D is a plan view for explaining the manufacturing method of the electron source substrate.
Figure 12:
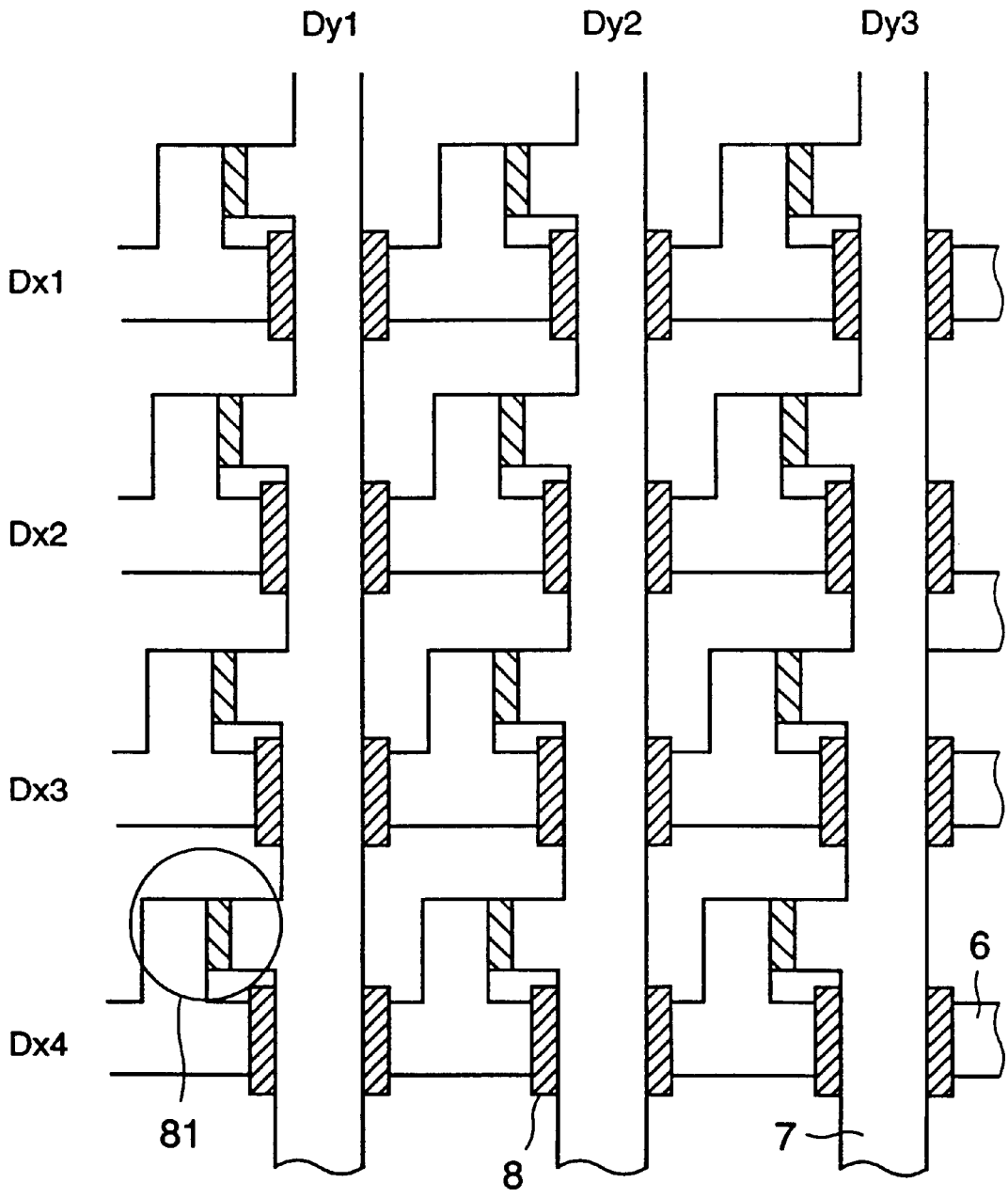
FIG.12 PRIOR ART
FIG. 12 is a plan view showing one portion of a conventional electron source.
Figure 13:
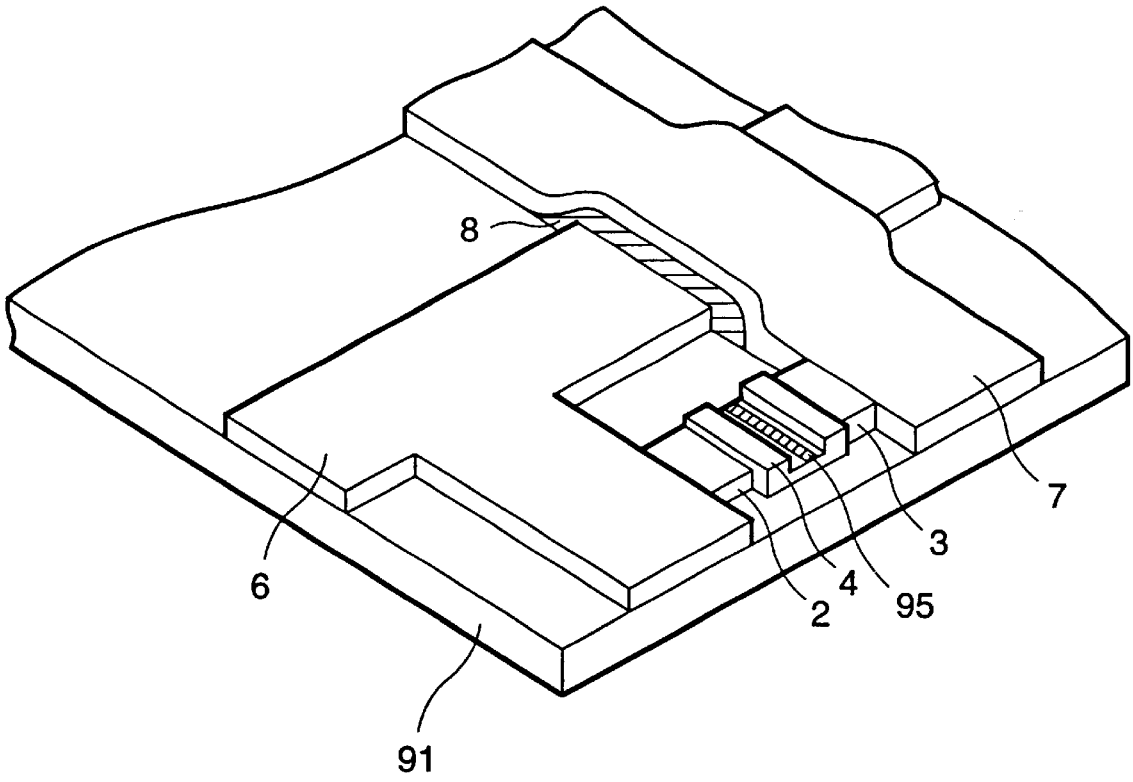
FIG.13 PRIOR ART
FIG. 13 is a perspective view in which a peripheral portion of a surface conduction electron-emitting device in FIG. 12 is taken out.

The basic structure of an image-forming apparatus in this embodiment is similar to that in FIGS. 3 and 7. A manufacturing method of the image-forming apparatus in this embodiment is shown in FIGS. 10 and 11. The basic structure and the manufacturing method of the image-forming apparatus in the present invention will next be explained by using FIGS. 7, 10A through 11D.

(Process-a)

Similar to the embodiment 1, device electrodes 2, 3 are formed on a cleaned glass substrate 1 (FIG. 10A).

(Process-b)

Similar to the embodiment 1, a wiring 6 is formed. Here, a conductive member 9 is simultaneously formed in a predetermined position, i.e., in each of four corner positions of an image forming region on its outer side (FIG. 10B). The distance between the conductive member 9 and the wiring 6 is set to be equal to or smaller than about 200 um.

(Process-c)

Similar to the embodiment 1, an insulating layer 8 is next formed. Here, when the next upper wiring is formed, the insulating layer 8 is also formed on the conductive member 9 such that no conductive member 9 is connected to a most proximate upper wiring (FIG. 10C).

(Process-d)

Similar to the embodiment 1, the upper wiring 7 is formed. Here, the conductive member 9 is formed such that this conductive member 9 is connected to a wiring 7 next to the most proximate wiring 7 (FIG. 11D). The distance between the conductive member 9 and the most proximate wiring of the wirings 7 is set to be equal to or smaller than about 200 $\mu$m.

A substrate having device electrodes 2, 3 connected to each other by the wirings 6, 7 in a matrix shape can be formed by the above processes.

After the process-e, the image-forming apparatus in this embodiment is manufactured by the same process as the embodiment 1 and an image is displayed.

As a result, a preferable image can be stably displayed for a long time with luminance (about 150 fL) able to be sufficiently satisfied as a television, and an image of high quality having no image disturbance is also obtained in each of four corner areas.

As explained above, in accordance with the present invention, charging on a surface of high electric resistance exposed to the surface of an electron source substrate is restrained, and an influence on the orbit of an electron emitted from an electron-emitting device is excluded. Accordingly, it is possible to realize an image-forming apparatus of a flat type having a large screen and able to hold a preferable image for a long time, e.g., a color flat television.

What is claimed is:

1. An image-forming apparatus having an image forming region formed in an approximately rectangular shape, comprising:

an electron source substrate in which electron-emitting devices are connected to m pieces of X-directional wirings and n pieces of Y-directional wirings electrically insulated from each other, and are arranged in matrix; and a face plate spaced oppositely from the electron source substrate approximately at a constant distance, and having an anode electrode and a fluorescent film therein, wherein conductive members, each of which is electrically connected to one of said X-directional wirings and said Y-directional wirings, are arranged respectively in four regions, which are positioned outside of said forming region on said electron source substrate, in which said four regions said X-directional wirings and said Y-directional wirings are not disposed, and which said four regions are positioned respectively in a vicinity of four corners of the approximately rectangular shape of the image forming region, and a space between said face plate and said electron source substrate is maintained at a reduced pressure and said conductive member is positioned in said space.

2. An image-forming apparatus according to claim 1, wherein said conductive members are electrically connected to at least one of said wirings except for a most proximate wiring.

3. An image forming apparatus having an airtight container, comprising:

an electron source substrate in which plural electron-emitting devices connected to m pieces of X-directional wirings and n pieces of Y-directional wirings electrically insulated from each other are arranged in matrix; and a face plate arranged oppositely to the electron source substrate and having a fluorescent film and an anode electrode, wherein the interior of said airtight container has a region in which widths of said X-and Y-directional wirings arranged on the outer side of an image forming region are wider than those arranged within said image forming region, and a space between said faced plate and said electron source substrate is maintained at a reduced pressure.

4. An image-forming apparatus having an airtight container, comprising:

an electron source substrate in which plural electron-emitting devices connected to m pieces of X-directional wirings and n pieces of Y-directional wirings electrically insulated from each other are arranged in matrix; and a face plate arranged oppositely to the electron source substrate and having a fluorescent film and an anode electrode, wherein an image forming regions substantially formed in a rectangular shape is arranged within said airtight container, an outer side of said image forming region in proximity to four corners of the image forming region has a region in which widths of said X- or Y-directional wirings are wide in comparison with an interior of said image forming region, and an interior of the airtight container is maintained at a reduced pressure.

5. An image-forming apparatus according to any one of claims 1 to 4, wherein said electron-emitting devices are cold cathodes.

6. An image-forming apparatus according to claim 5, wherein said electron-emitting devices are surface conduction electron-emitting devices.

7. An image display apparatus comprising:

an electron source substrate provided with a plurality of X-directional wirings, a plurality of X-directional wirings crossing said plurality of Y-directional wirings and a plurality of electron-emitting devices each of which is connected to one of said X-directional wirings and one of said Y-directional wirings; and a face plate provided with a phosphor film and an anode electrode, wherein a space between said face plate and said electron source substrate is maintained at a reduced pressure, and wherein, in said space, said X-directional wirings and said Y-directional wirings have greater width outside of an image displaying region than within the image displaying region.

8. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, a width of the m pieces of said X-directional wirings outside of an image forming region is greater than any width of the m pieces of said X-directional wirings within the image forming region.

9. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, a width of the n pieces of said Y-directional wirings outside of an image forming region is greater than any width of the n pieces of said Y-directional wirings within the image forming region.

10. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, said X-directional wirings have greater width outside of an image forming region than within the image forming region.

11. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, said Y-directional wirings have greater width outside of an image forming region than within the image forming region.

12. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, at least one of said X-directional wirings has greater width outside of an image forming region than within the image forming region.

13. An image forming apparatus having an airtight container, comprising:

an electron source substrate on which a plurality of electron-emitting devices, m pieces of X-directional wirings and n pieces of Y-directional wirings are arranged, each electron-emitting device being connected to one of the m pieces of said X-directional wirings and one of the n pieces of said Y-directional wirings; and a face plate having a fluorescent film and an anode electrode, wherein a space between said face plate and said electron source substrate is maintained at a reduced pressure, and wherein, in said space, at least one of said Y-directional wirings has greater width outside of an image forming region than within the image forming region.

14. The image forming apparatus according to any one of claims 8 to 13, wherein said electron emitting device is a field emitter.

15. The image forming apparatus according to any one of claims 8 to 13, wherein said electron-emitting device is a surface conduction electron-emitting device.

* * * * *

UNITED STATES PATENT AND TRADEMARK OFFICE

CERTIFICATE OF CORRECTION

PATENT NO. : 6,635,984 B1
DATED : October 21, 2003
INVENTOR(S) : Masaaki Shibata It is certified that error appears in the above-identified patent and that said Letters Patent is hereby corrected as shown below:

Column 7,
Line 3, “material” should read -- material, --.

Column 14,
Line 64, “X-and” should read -- X- and --.

Column 15,
Line 1, “faced” should read -- face --.
Line 14, “regions” should read -- region --;
Line 32, “X-directional” (second occurrence) should read -- Y-directional --; and
Line 33, Y-directional” should read -- X-directional --.

Column 18,
Line 8, “electron emitting” should read -- electron-emitting --.

Signed and Sealed this

Twenty-third Day of March, 2004

JON W. DUDAS
*Acting Director of the United States Patent and Trademark Office*